US007117792B2

(12) United States Patent
Faist et al.

(10) Patent No.: US 7,117,792 B2
(45) Date of Patent: Oct. 10, 2006

(54) METHOD AND DEVICES FOR REGULATING AT LEAST ONE CYLINDER IN A PRINTING PRESS

(75) Inventors: Bernd Klaus Faist, Ochsenfurt (DE); Wolfgang Otto Reder, Veitshöchheim (DE); Georg Schneider, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 140 days.

(21) Appl. No.: 10/496,319

(22) PCT Filed: Sep. 21, 2002

(86) PCT No.: PCT/DE02/03574

§ 371 (c)(1),
(2), (4) Date: Jun. 4, 2004

(87) PCT Pub. No.: WO03/049947

PCT Pub. Date: Jun. 19, 2003

(65) Prior Publication Data

US 2005/0076800 A1 Apr. 14, 2005

(30) Foreign Application Priority Data

Dec. 6, 2001 (DE) ..... 101 60 044

(51) Int. Cl.
*B41F 31/00* (2006.01)

(52) U.S. Cl. ..... 101/352.05; 101/352.01; 101/247; 101/217; 101/218

(58) Field of Classification Search ..... 101/352.01, 101/352.05
See application file for complete search history.

(56) References Cited

U.S. PATENT DOCUMENTS 2,892,399 A 6/1959 Chase
3,550,529 A 12/1970 Henc et al.
4,354,431 A * 10/1982 Fischer ..... 101/247
4,503,771 A * 3/1985 Herzel et al. ..... 101/247
4,520,729 A 6/1985 Fischer
4,625,642 A 12/1986 Despot et al.
5,142,977 A 9/1992 Gertsch et al.
5,152,224 A 10/1992 Guaraldi
5,201,586 A 4/1993 Zimmermann et al.
5,228,390 A 7/1993 Jahn
5,311,817 A * 5/1994 Funada ..... 101/177
5,355,796 A 10/1994 Kobler et al.
5,388,514 A 2/1995 Eltner
5,819,656 A 10/1998 Gertsch et al.
6,098,542 A 8/2000 Dufour (Continued)

FOREIGN PATENT DOCUMENTS

DE 64 064 10/1968

(Continued)

*Primary Examiner*—Andrew H. Hirshfeld
*Assistant Examiner*—Marissa Ferguson-Samreth
(74) *Attorney, Agent, or Firm*—Jones, Tullar & Cooper, P.C.

(57) ABSTRACT

The forces exerted by actuators are detected and devices are provided, which use those detected forces to regulate a pressure force exerted by one cylinder against another cylinder in a printing machine. The several forces can also be used for placing or removing one cylinder with respect to another cylinder. One cylinder may be mounted in a cylinder holder which is, in turn, mounted in a frame holder. At least two actuators are arranged between the cylinder holder and the frame holder. These actuators exert a radially directed force against the cylinder holder when they are actuated by a control signal.

54 Claims, 12 Drawing Sheets

U.S. PATENT DOCUMENTS 6,397,744 B1 6/2002 Jentzsch et al.

FOREIGN PATENT DOCUMENTS

| | | | |
|---|---|---|---|
| DE | 1 561 014 | | 2/1970 |
| DE | 27 36 175 | | 2/1979 |
| DE | 32 41 862 | | 9/1983 |
| DE | 33 03 988 | A1 | 9/1984 |
| DE | 34 40 895 | A1 | 5/1986 |
| DE | 38 25 517 | C2 | 9/1990 |
| DE | 3926088 | C1 | 10/1990 |
| DE | 42 11 379 | A1 | 10/1993 |
| DE | 42 30 090 | A1 | 3/1994 |
| DE | 44 39 144 | A1 | 5/1996 |
| DE | 197 30 681 | A1 | 4/1998 |
| DE | 19800475 | A1 | 7/1999 |
| DE | 19801623 | A1 | 7/1999 |
| DE | 100 01 582 | A1 | 8/2000 |
| DE | 10113313 | A1 | 9/2002 |
| EP | 0 475 120 | A1 | 8/1991 |
| EP | 0 826 501 | A1 | 9/1996 |
| EP | 0 958 918 | A1 | 4/1999 |
| GB | 1213903 | | 11/1970 |
| GB | 1213935 | | 11/1970 |
| GB | 2333265 | A | 1/1999 |
| WO | WO 02/074542 | A2 | 9/2002 |

* cited by examiner

METHOD AND DEVICES FOR REGULATING AT LEAST ONE CYLINDER IN A PRINTING PRESS

FIELD OF THE INVENTION

The present invention is directed to methods and to devices for setting a pressure force exerted by at least one roller on another roller of a printing press, and for bringing the at least one roller intoout of contact with one of these other rollers. The at least one roller is held in a roller holder which is, in turn, seated in a frame holder.

BACKGROUND OF THE INVENTION

Inking units or dampening units of printing presses are employed for conveying an ink or a required dampening agent from appropriate supply devices to printing zone. Rollers or cylinders are provided in the inking unit or in the dampening unit for forming the required ink film or dampening agent film. The term roller and cylinder have the same meaning for understanding the present invention and will be used interchangeably. The rollers come into contact with each other along so-called roller strips. The ink film or the dampening agent film can be transferred in the roller strips from one roller to another roller.

Rollers, which are adjustably supported in a machine frame, are provided in such inking units or dampening units. A contact pressure in the roller strips can be changed by displacing these adjustably seated rollers with respect to the other rollers. An inking unit, with a distribution roller seated fixed in the frame and with a forme cylinder also seated fixed in the frame, is known from EP 0 826 501 A1. Inkis transferred from the distribution roller to the forme cylinder by use of an application roller that is arranged between the distribution roller and the forme cylinder. The application roller is itself adjustably seated in the machine frame and can be pressed, with an adjustable force, into the gap between the distribution roller and the forme cylinder. The device for seating the application roller is embodied in this prior device in such a way that the force with which the application roller is pressed into the gap between the distribution roller and the forme cylinder always acts along a bisecting line of an angle. In other words, although the size of the force for pressing the application roller can be changed, the direction of the force is unchangeably preset by the structural embodiment of the setting device. Thus, only the size of the contact pressure force can be changed for setting the contact pressure in the roller strips between the forme cylinder and the distribution roller on the one hand, and the application roller on the other hand. The resulting contact pressures in the roller strips ensue on the basis of the preset geometry.

A device for clamping bearing bushes of printing and forme cylinder bearing of a printing press is known from the Letters Patent DD 64 064. The device provides a hydraulic force for pressing the bearing bushes against the bore wall of the machine frame. The bearing bushes consist of two bushing sleeves shrunk on each other. Two hydraulically chargeable pressure chambers have been worked into the inner wall of the outer bearing bush, which pressure chambers are placed on both sides at 120° in respect to the resultant of the mean forces acting on the bearing. The true running properties of the cylinders are improved with this device, because a movement of the cylinders which is, to a large extent, vibration-free is achieved by the removal of the play which the bearing bushes have in the bore of the machine frame which receives them.

Letters Patent DE 15 61 014 C1 shows a roller bearing which is adjustable in only one direction, and which is used, in particular, for distribution and application rollers of inking units of printing presses. Setting assemblies, for adjusting the roller transversely in respect to its axis, are provided. The setting assemblies are arranged between a bearing journal connected with the frame wall and a housing, which housing receives one roller end and which is preferably embodied in a cup shape. The bearing journal and the housing are connected with each other by spring elements, which act oppositely to the setting assemblies. Here, the spring elements are preferably embodied as radially extending rubber bumpers, and the setting assemblies acting on the bearing journal are either embodied as a radially arranged setting screw, or as two setting screws arranged at 45°. In accordance with a further embodiment, the engagement or the disengagement of the roller, and therefore the adjustment of the roller bearing, can also take place by the use of two pressure chambers, which are diametrically arranged inside the housing and which can be acted on by air or a fluid, wherein the pressure chambers acting against each other are selectively charged with pressure.

A device for setting a contact pressure between rollers of a printing press is known from DE 100 01 582 A1. Hydraulic actuating elements, which are preferably embodied as double piston cylinders, are arranged between the adjoining rollers.

A device and a method for the semi-automatic setting of rollers is known from EP 0 958 918 A1. An adjustable first roller is placed against at least one second roller fixed in the frame. Spring-elastic elements charge the first roller with a spring-elastic force in the direction of the second roller.

SUMMARY OF THE INVENTION

The object of the present invention is directed to providing methods and devices for setting a pressure force exerted by at least one roller on another roller of a printing press and is also directed to methods and devices for bringing the at least one roller either intoout of contact with one of these rollers.

In accordance with the present invention, this object is attained by the provision of at least three rollers in a printing press wherein a contact pressure is exerted by the first roller against the second and third rollers. The first roller is held in a roller holder which is, in turn, seated in a frame holder. At least two actuators are arranged between the roller holder and the frame holder. These two actuators, in their actuating operational state, exert a force which is radially directed onto the roller holder.

The advantages to be gained by the present invention lie, in particular, in that, in the course of setting the contact pressure between the adjustable roller and the rollers resting against it, not only is the value of the force varied, but also the direction of the force is varied. Because of this, it is possible for the contact pressures in the two roller strips to be set independently of each other in the end.

Particular advantages, in regard to the idle or down times during setting the inking unit or dampening unit, result if the pressing-in force into the roller strip is not set in sequential steps, but substantially at the same time. This means that, in the course of setting the force with which the adjustably seated roller is pressed against the other rollers, the value of the force and the force direction can be varied until the respectively desired contact pressures ensue in all of the various roller strips.

To prevent an unintentional change of the contact pressures, it is advantageous if, after the contact pressure against the other two rollers has been set, the position of the adjustably seated roller can be fixed by actuating or engaging a fixing device. If the value and the direction of the force for use in adjusting the adjustably seated roller can be selected substantially freely, this can also be used for turning the ink or the dampening agent off. For these cases of application, the force for adjusting the adjustably seated roller is selected to act in a direction which points away from the other two rollers. As a result, the adjustably seated roller can be moved out of the gap far enough to insure that there is no longer contact between the adjustably seated roller and the other rollers. As soon as the adjustably seated roller has been separated from the other rollers, no ink or dampening agent is transmitted into the roller strip.

It is also possible, in an alternative configuation, to arrange the adjustably seated roller on a lever arrangement which can be pivoted around the axis of rotation of one of the other rollers. For turning off the ink or the dampening agent, the roller can then be lifted off one of the other rollers by operating the lever arrangement. After moving the lever arrangement into the function position, in which function position the adjustably seated roller comes into contact with the other two rollers, the adjustably seated roller can be pushed into the gap between the other two rollers by a force whose value and whose direction can be adjusted. This setting is then secured in place by the actuation of a fixing device located between the adjustably seated roller and the lever arrangement. If, at a future time, the ink or the dampening agent is to be turned off, the lever arrangement is pivoted into the first function position, in which the adjustably seated roller is lifted off the one roller. When turning the ink or the dampening agent on, it is then sufficient to pivot the lever arrangement back into the second function position, without an additional setting of the contact pressures, since the correct setting is fixed by the fixing device between the lever arrangement and the adjustably seated roller.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
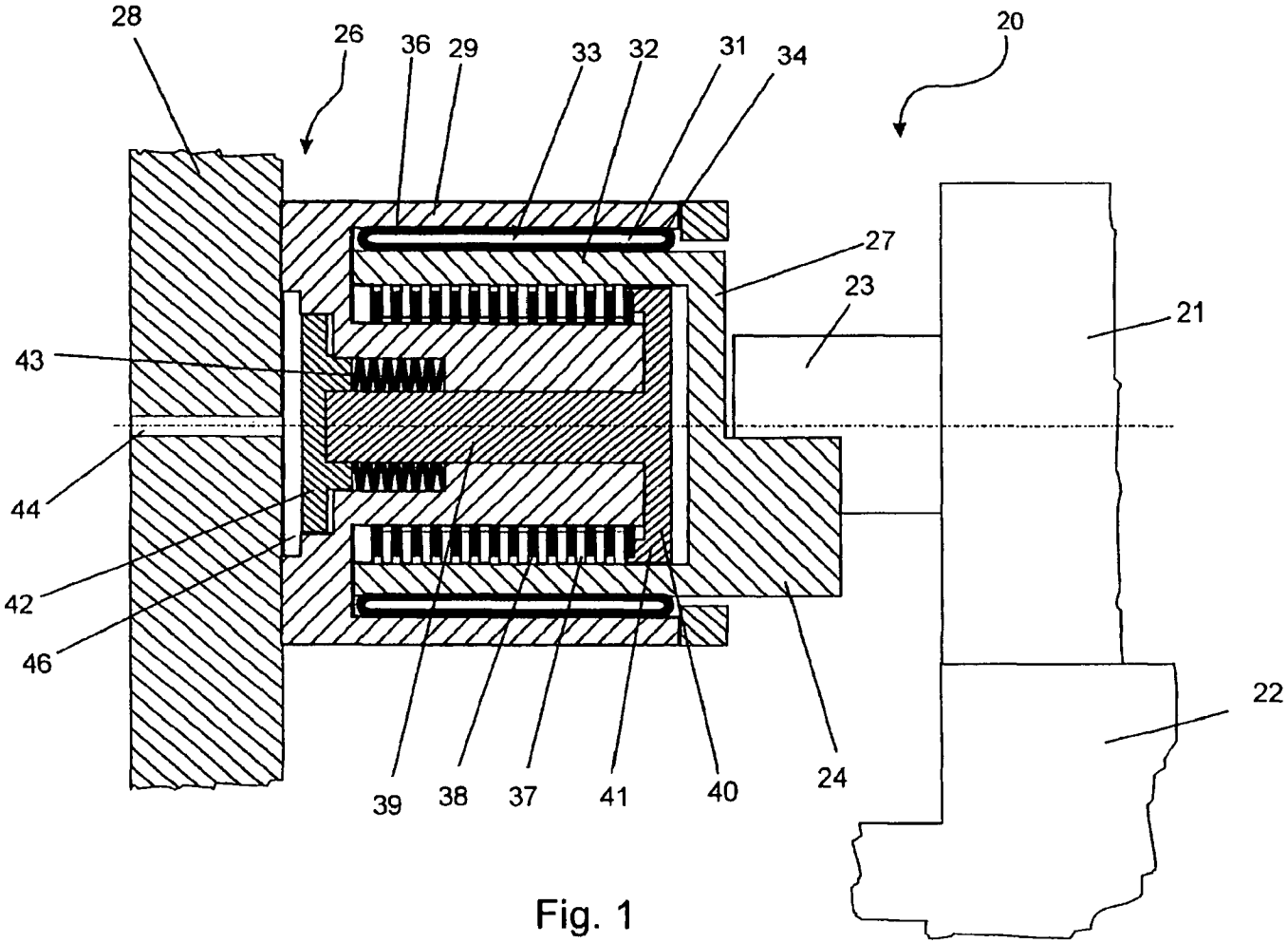
FIG. 1, a schematically depicted device for setting the contact pressure between two rollers in longitudinal section, in FIG. 2, the schematically depicted device of FIG. 1 in a basic position, in FIG. 3, the schematically depicted of FIG. 1 in a deflected position, in FIG. 4, the device in accordance with FIG. 1 in a perspective view and without a roller holder, in FIG. 5, the device in accordance with FIG. 1 in a perspective view and with a roller holder, in FIG. 6, a schematically represented lateral view of a portion of an inking unit, in FIG. 7, a second preferred embodiment of an inking unit in a schematically represented side elevation view, in FIG. 8, a portion of the inking unit in accordance with FIG. 7 in a schematically represented side elevation view, with a roller placed against two rollers and with an associated diagram of the force vectors, in FIG. 9, a portion of the inking unit with two rollers placed against each other and with an associated diagram of the force vectors, in FIG. 10, a portion of the inking unit with a roller moved out of contact and with an associated diagram of the force vectors, in FIG. 11, a portion of the inking unit with a roller placed against two rollers and with a representation of the radial forces of the actuators, in FIG. 12, a third preferred embodiment of a roller arrangement with two rollers which can be independently placed against a third roller and are placed against it, and in FIG. 13, a fourth preferred embodiment of an inking system in a schematically represented side elevation view.

A device 20 for setting a contact pressure between a first roller 21 and a second roller 22 is represented in FIG. 1. An end of a shaft or journal 23 of the roller 21 can be fastened on a quick-release closure or coupling 24 provided on the contact pressure setting device 20. Such quick-release closures or couplings 24 are generally known in the prior art and have a lower semicircular bearing shell, into which the end of the shaft 23 can be inserted. By fastening an upper bearing shell, which is not specifically represented in FIG. 1, to the lower semicircular bearing shell the shaft 23 can be fixed in place in the quick-release closure or coupling 24.

The contact pressure setting device 20 is substantially constructed of a frame holder 26 and of a roller holder 27, which two holders can be displaced in relation to each other in an actuating plane extending vertically in respect to the drawing plane. The frame holder 26 is constructed of a base plate 28, which can be pivotably fastened on the frame of a printing press, for example by the use of a pivot arm, and of a sleeve body 29. On the side facing the roller 21, the sleeve body 29 has a recess 31, which is engaged by a cylinder-shaped section 32 of the roller holder 27. In this case, an inner diameter of the recess 31 or an outer diameter of the section 32 have been selected in such a way that a gap 33 is formed between the two, which gap is circular cylindrical, or annular in a base position, and which has a gap width of, for example, 1 mm to 10 mm, and preferably of 2 mm. The maximum actuating range for displacing the roller holder 27 relative to the frame holder 26 is defined by the gap 33.

Figure 4:
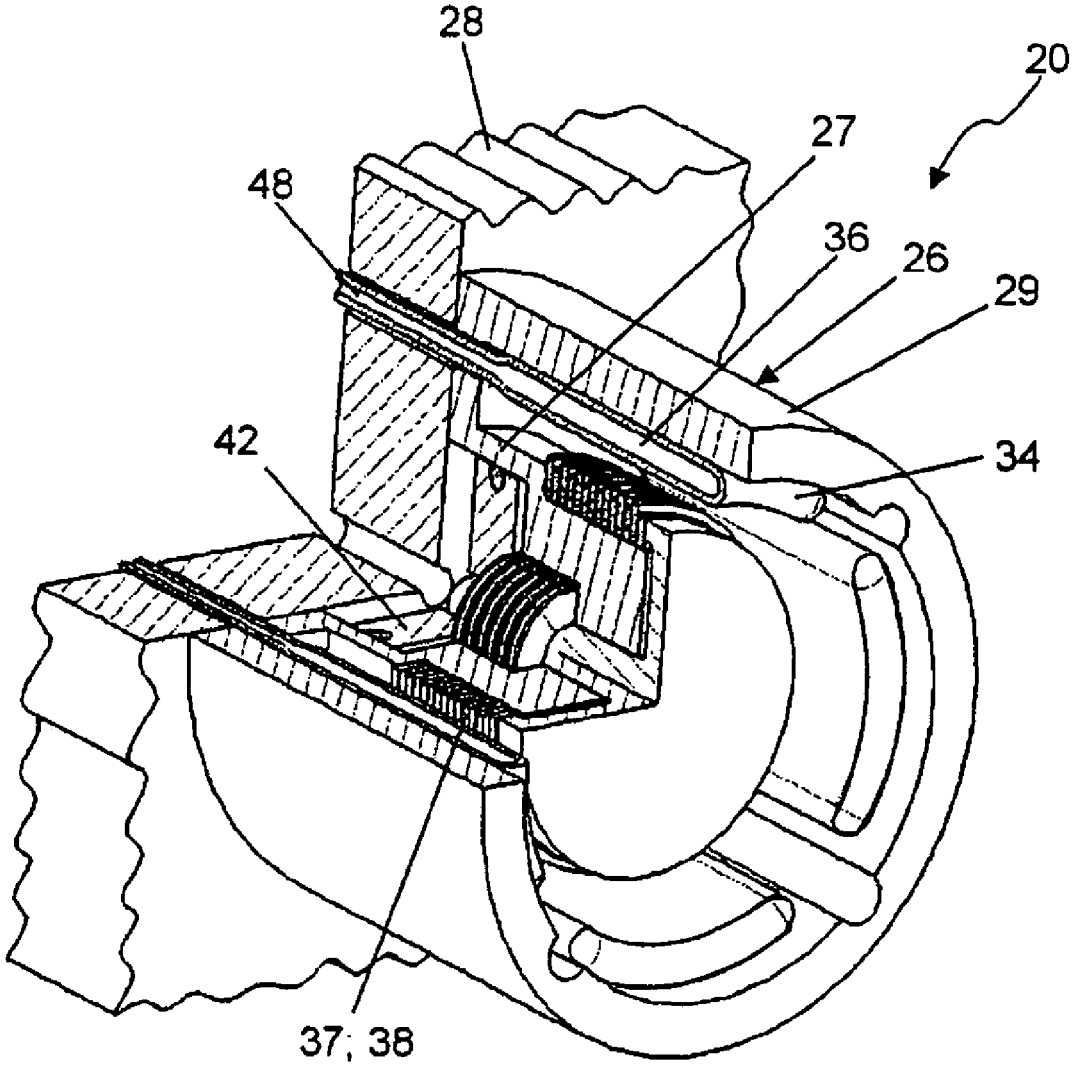

To be able to provide the actuating movement required for setting the roller 21, or to apply the desired contact pressure between the roller 21 and the roller 22, preferably four actuators 34, which actuators 34 are, for example, embodied in the form of flexible pressure tubings 34, are arranged distributed about the circumference of the gap 33, of which only two such actuators are represented in cross-section in FIG. 1. The pressure chambers 36 constituted by the walls of the actuators 34 can be charged with pressure via service lines 48, as seen in FIG. 4, which lines 48 are not represented in FIG. 1. A resultant force acts on the roller holder 27 as a function of the respective pressure conditions in the four actuators 34, so that the roller 21 can be pressed against the roller 22 with the desired contact pressure by an appropriate regulation of the pressure in each of the plural actuators 34. Since the air cushion under pressure in the actuators 34 is compressible, it is possible to intercept mechanical interferences by utilization of the resultant spring effect.

To fix the roller holder 27 in place, relative to the frame holder 26, disk elements 37 are fastened on the roller holder 27, which disk elements 37 are arranged, meshing with disk elements 38 fastened on the sleeve body 29, to form a multi-disk packet. For the preferably frictionally connected clamping of the multi-disk packet formed by the disk elements 37, 38, a plunger 39, which is T-shaped in cross section, is provided, whose circular plunger head 40, which is located at a first end of a plunger post, comes to rest, through the provision of a circular flange 41, against the outermost disk element 37 or 38 of the multi-disk packet. A pressure plate 42 is fastened on the second, opposite end of the plunger post of the plunger 39, on which pressure plate 42 the spring force of a spring element 43, which is embodied in the manner of a plate spring packet 43, acts. The spring element 43 is mounted under pre-tension between the pressure plate 42 and the sleeve body 29, so that the multi-disk packet constituted by the disk elements 37, 38 is clamped by the spring force transmitted to the disk elements 37, 38 by the plunger 39.

In order to displace the roller holder 27 relative to the frame holder 26, in particular when setting the contact pressure between the rollers 21, 22, it is necessary to release the fixing device, which is constituted by the disk elements 37, 38, by movement of the plunger 39 and the pressure plate 42. For this purpose a pressure connector 44 is provided in the base plate 28, by the use of which, a pressure chamber 46 located between the pressure plate 42 and the base plate 28 can be charged with a pressure medium, for example compressed air. As soon as the air pressure acting on the pressure plate 42 overcomes the spring force of the spring element 43, circular flange 41 of the plunger head 40 of the plunger 39 is lifted off the outermost disk element 37 or 38 so that the latter are no longer clamped by being frictionally connected and thus can be displaced relative to each other.

Setting of the contact pressure between the rollers 21 and 22 takes place, for example, in the following manner:

First, the pressure chamber 46 is charged with sufficient pressure, so that the disk elements 37, 38 are no longer clamped by no longer being frictionally connected. Thereafter, the actuators 34 are each charged with just enough pressure so that a desired contact pressure between the rollers 21 and 22, or between the roller 21 and further rollers, which are not specifically represented in FIG. 1, is established and results in the formation of a contact strip between the rollers of the desired width. As soon as the correct contact pressure between the rollers 21 and 22 has been established, the pressure in the pressure chamber 46 is released, because of which pressure release, the plunger 39 again clamps the disk elements 37, 38 together, so that the roller holder 27 is fixed in the desired position in relation to the frame holder 26. Finally, the pressure in the actuators 34 is released. Independently of the above-described method, the fixing device, which preferably is embodied to be frictionally connected, can also alternatively or additionally have elements which are in positive engagement.

Figure 2:
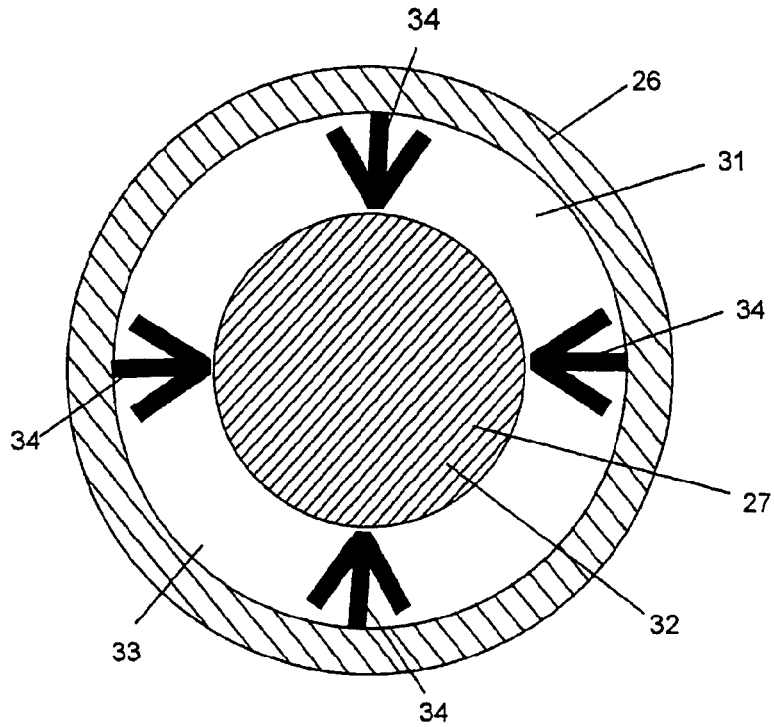
Figure 3:
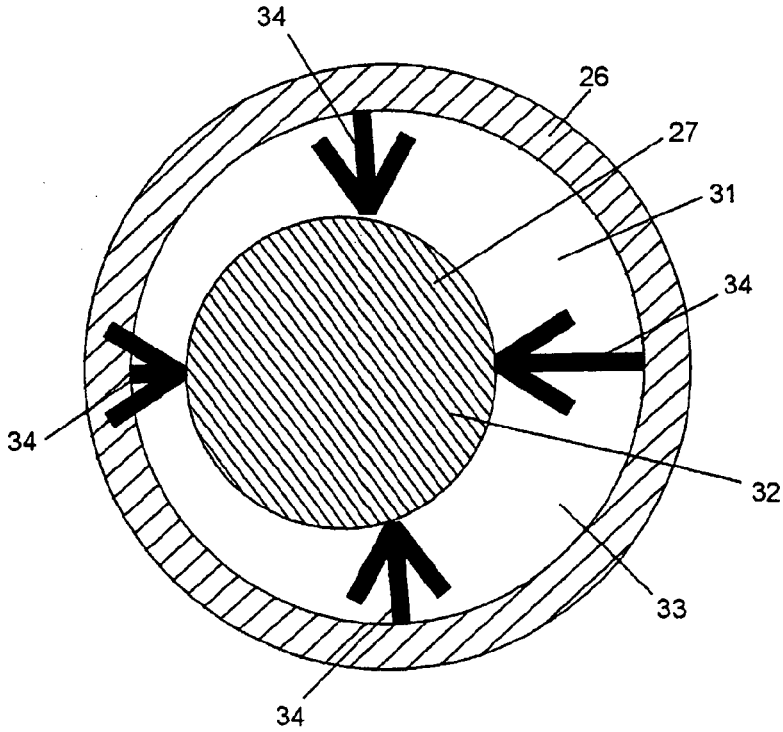

The effective principle of the device 20, during the required actuating movement described above, is schematically represented in FIG. 2 and in FIG. 3.

FIG. 2 shows the frame holder 26 with the recess 31 and the section 32 of the roller holder 27 supported by it. By properly selecting the dimensions of the two, a gap 33 is formed between the frame holder 26 and the section 32 of the roller holder 27, in which the actuators 34 are arranged, as previously discussed, which actuators 34 are only schematically indicated by force arrows in FIGS. 2 and 3. The possible actuating movements between the frame holder 26 and the roller holder 27 are defined by an actuating plane, which extends in the drawing plane in the representations in FIGS. 2 and 3, wherein the actuating range of the actuating movements is limited by the width of the gap 33.

As shown, by way of example, in FIG. 3, the roller holder 27, and, as a result, the roller 21 fastened on it, can be laterally offset relative to the frame holder 26, which lateral offsetting is achieved by an appropriate control of the actuators 34 and by the resultant force effect which the spaced actuators 34 exert on the section 32. As soon as the desired position of the roller holder 27, relative to the frame holder 28, has been achieved, the fixing device, constituted by the disk elements 37, 38, or by the plunger 39 and the pressure plate 42, can be actuated, so that the position of the roller holder 27 is permanently fixed, with respect to the frame holder 28, and the actuators 34 need no longer be operated.

Figure 5:
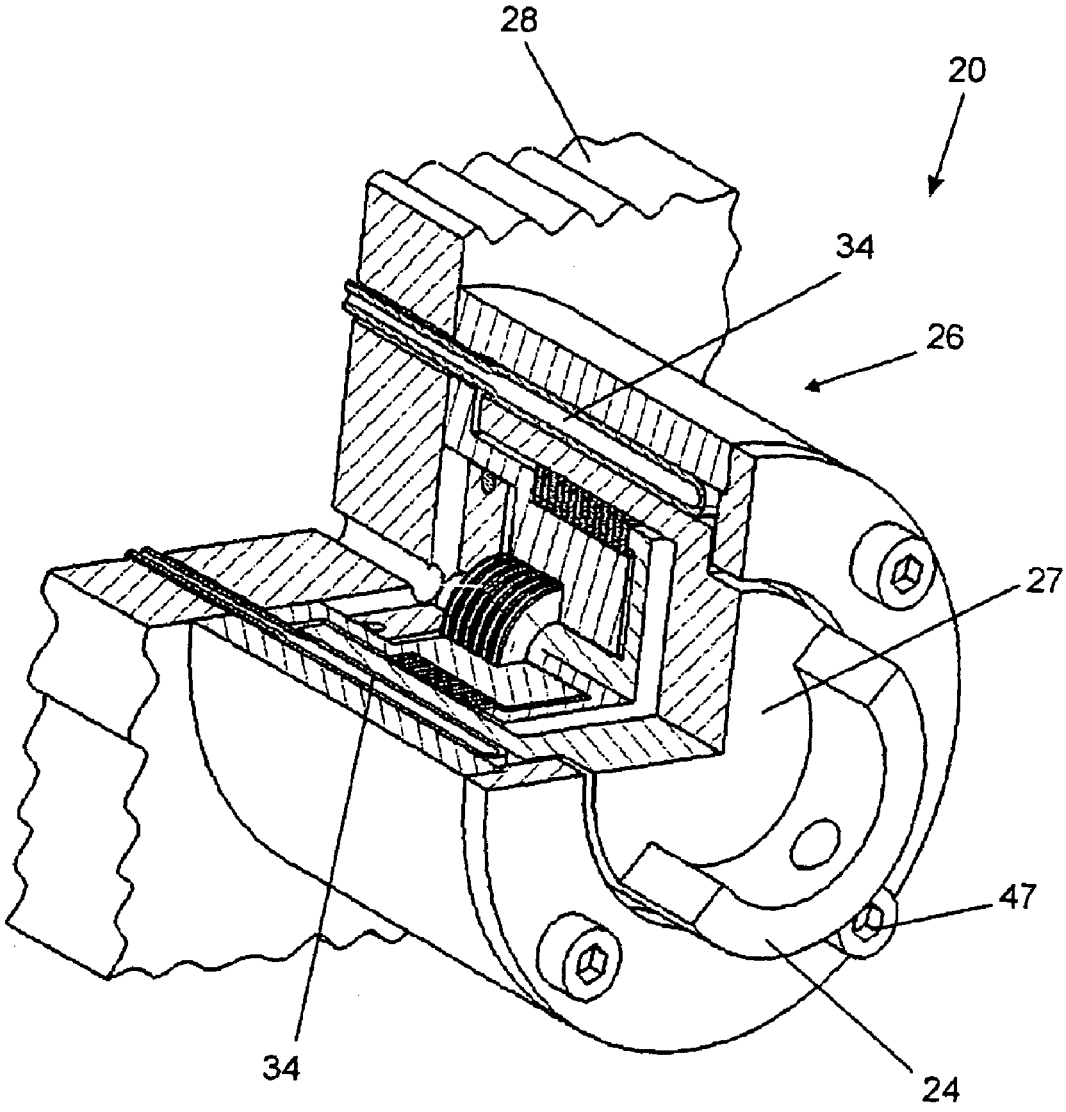

The contact pressure setting device 20, in accordance with the present invention, is represented in a perspective view in FIG. 4 and without the roller holder 27. The sleeve body 29 is fastened on the roller holder 27 by the use of four fastening screws 47, as seen in FIG. 5. The four actuators 34, which for example, are embodied in the form of flexible pressure tubings 34, which can be charged with compressed air via service lines 48, are arranged between the sleeve body 29 of the frame holder 26 and the roller holder 27, on whose forward oriented side the half-shell-shaped quick-release closure 24, again referring to FIG. 5 can be partially seen. The disk elements 37, 38 can be relaxed by use of the pressure plate 42.

FIG. 5 shows the contact pressure setting device 20 with the base plate 28, the frame holder 26, the roller holder 27, the quick-release closure 24, the fastening screws 47 and the actuators 34 in a perspective view from the front. The extremely compact construction of the contact pressure setting device 20 can be seen, which construction, based on its entirely rotationally symmetrical design, except for the base plate 28 has a lesser diameter than the roller 21 itself as may be seen in FIG. 1.

Figure 6:
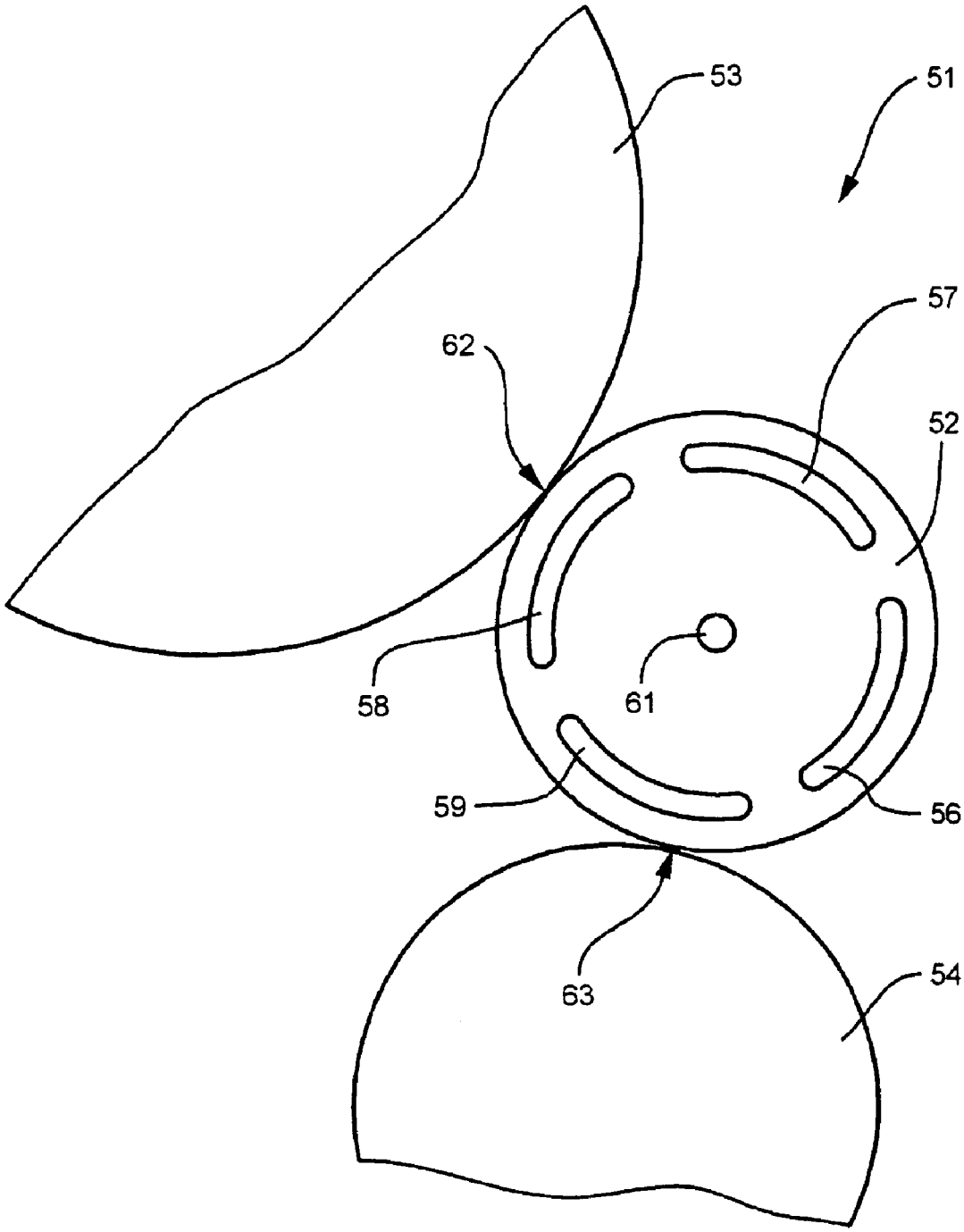

A portion of an inking unit 51, with an adjustably seated roller 52 and with two fixed rollers 53, 54, which are seated fixed in place on the frame, is represented in FIG. 6. The adjustably seated or supported roller 52 is seated or supported in the machine frame by a contact pressure setting device 20 as explained in FIGS. 1 to 5. This device 20 is schematically depicted in FIG. 6 by the air chambers 56 to 59 and 61. The function of the pressure chambers 56 to 59 corresponds to the function of the pressure chambers 36 at the device 20. This means that by charging the pressure chambers 56 to 59 with air, by or releasing air from them, the adjustably seated roller 52 can be pressed into a gap defined between the rollers 53 and 54, or can be moved out of the gap. The function of the pressure chamber 61 corresponds to the function of the pressure chamber 46 in the device 20, so that the position of the adjustably seated roller 52 in relation to the rollers 53 and 54 fixedly seated in the frame can be arrested or fixed by charging the pressure chamber 61 with air, or by releasing air from the pressure chamber 61.

To set the contact pressure exerted in the roller strips 62, 63 between the rollers 53 and 54, respectively on the one hand, and the adjustably seated roller 52 on the other hand, the following procedure can be followed.

First, an individual amount of air pressure is applied to each of the pressure chambers 56 and 57, which results in a setting force on the roller 52 of the desired size and value. Thereafter, the pressure chamber 61 is filled with compressed air in order to release the fixation or securement of the roller 52. The roller 52 is then pressed against the rollers 53 and 54 by the individual pressures exerted by each of the pressure chambers 57 and 56. By changing the pressure in the pressure chambers 56 and 57, the contact pressures in the roller strips 62 and 63 can be variably set independently of each other. As soon as the contact pressures in the two roller strips 62 and 63 correspond to the desired values, the pressure chamber 61 is evacuated by releasing the pressure from it, and the adjustably seated roller 52 is again fixed in place relative to the rollers 53 and 54.

The contact pressure in the roller strips 62, 63 can be changed by remote control. Adjusting of the contact pressure in the roller strips 62, 63 is also possible during a production run, since the ink transfer is not interrupted during such an adjustment. In the course of such an adjustment, during a production run, only the pressure chamber 61 is charged with air for releasing the fixing device, and the pressure in the pressure chambers 56, 57 is changed only to such an extent that the desired adjusted contact pressures in the roller strips 62, 63 results.

The fixation of the setting pressures, by releasing of pressurized air from the pressure chamber 61, is not absolutely required. If the setting pressures in the pressure chamber 56 and 57 are maintained during production, the fixation of the roller position of roller 52, by releasing air from the pressure chamber 61, can be omitted. In this case, the roller 52 is resiliently pressed against the rollers 53 and 54 and can yield, or be forced toward the back or away from the rollers 53 and 54, for example, in case of out-of-round running and possible vibrations. When the roller 52 is not fixed in place, by the pressure chamber 61, care must be taken to insure that the vibrations occurring in the inking unit 51 do not exceed a permissible value.

To interrupt an ink conveyance in the inking unit 51, i.e. to shut off the flow of ink, air is released from the pressure chambers 56 and 57. The pressure chamber 58 and 59 are concurrently charged with air. As soon as the fixation, or the securement, of the roller 52 is released, by charging the pressure chamber 61 with air, the roller 52 is moved out of the gap between the rollers 53 and 54. Once there is no longer any contact between the roller 52 and the rollers 53 or 54, the pressure chamber 61 is again charged with air and the roller 52 is thereby fixed in the disengaged position. As a result, it becomes possible by this operation to disengage the roller 52, even during a production run, without removal of the roller 52 from the press. To prevent errors because of binding of the roller 52 during the setting of the contact pressure exerted in the roller strips 62, 63, prior to setting the contact pressure, the roller 52 can also initially be disengaged in the described way by releasing air from the pressure chambers 56 and 57.

Through an appropriate control of the pressure chambers 56 to 59, it is, of course, also possible to disengage the roller 52 from only one of the rollers 53 or 54. If, for example, the pressure chambers 57,and 58 are charged with air, and the fixation or the securement of the roller 52 is released, it is possible to achieve a disengagement of the roller 52 from the roller 53, but at the same time to maintain roller 52 in contact with the roller 54.

Figure 7:
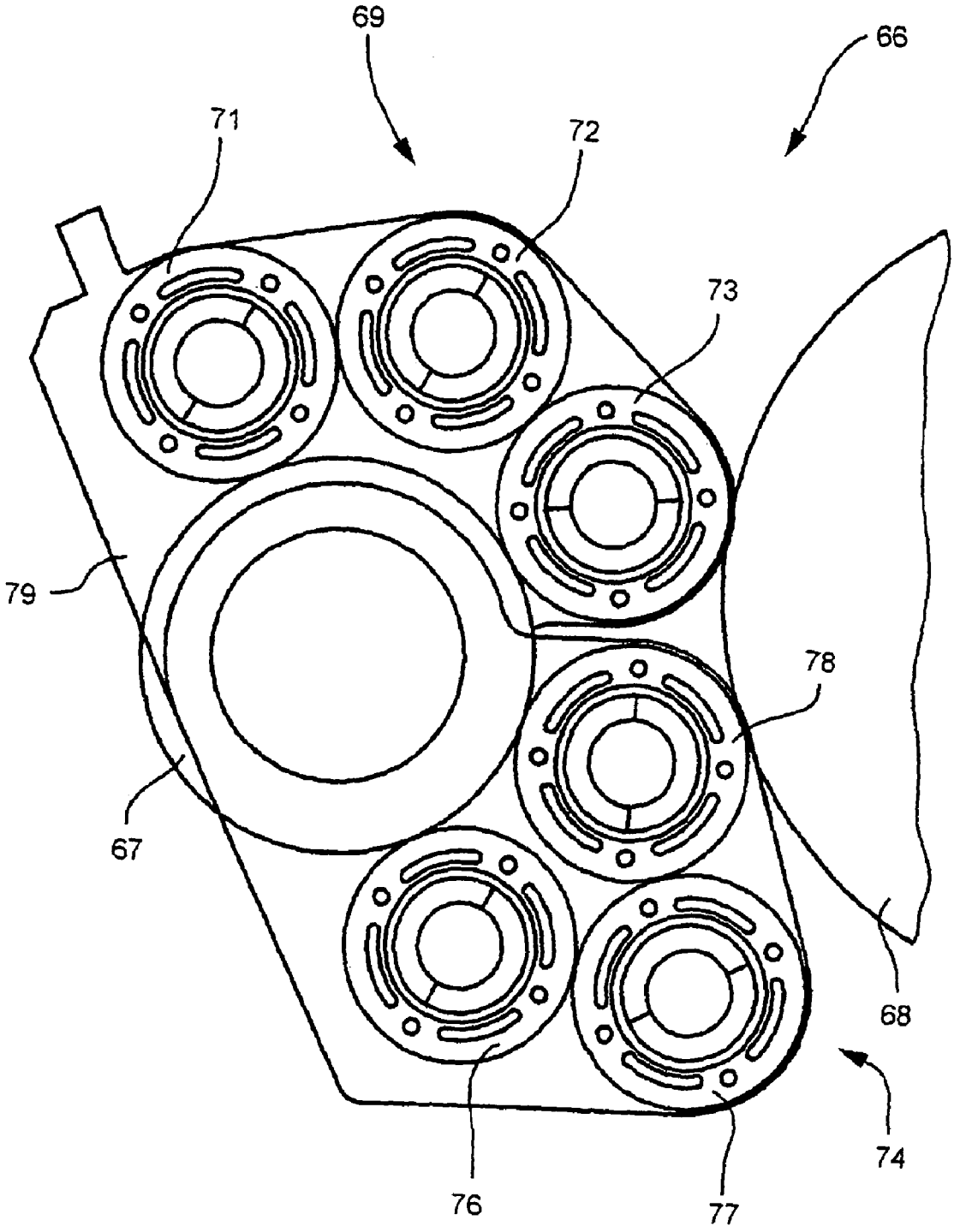

FIG. 7 represents an inking unit 66 from which ink can be transferred from a roller 67, for example a screen roller 67, to a cylinder 68, for example a forme cylinder 68. For this purpose, an upper roller train 69, with two rollers 71, 72, for example two ink transfer rollers 71, 72, and a roller 73, for example an ink application roller 73, and a lower roller train 74, also with two rollers 76 or 77, for example two ink transfer rollers 76 or 77, and an ink application roller 78, are provided in the inking unit 66. The ink transfer rollers 71, 72, 76, 77, as well as the ink application rollers 73, 78, are adjustably seated in a frame 79. Devices corresponding to the contact pressure setting device 20, for example, are used for adjusting these rollers 71, 72, 76, 77, 73, 78 each which rollers 71, 72, 76, 77, 73, 78 preferably has four pressure chambers for setting the contact pressures, or for disengaging the rollers 71, 72, 76, 77, 73, 78.

The setting of the contact pressures in the inking unit 66 can be provided in various ways. In accordance with a first embodiment, the contact pressures in the roller strips of the upper roller train 69 and the lower roller train74 are set sequentially. This means that the fixation or the securement of the ink application roller 73 is initially released, and the contact pressures in the roller strips between the ink application rollers 73 and the screen roller 67 and also the forme cylinder 68 are set by charging the appropriate pressure chambers with air. Parallel with this, the contact pressures between the ink application roller 78 of the lower roller train 74 and the screen roller 67, or the forme cylinder 68 can be set. After the ink application rollers 73 or 78 have been set, they are fixed in place. Thereafter, the contact pressure between the ink transfer roller 72 and the ink application roller 73, or the ink transfer roller 77 and the ink application roller 78, is set by charging the appropriate pressure chambers with air. As soon as the ink transfer rollers 72 and 77 have again be fixed in place, the ink transfer rollers 71 and 76 are lastly set by charging their respective pressure chambers with air, so that the desired contact pressures ensue in the roller strips between the ink transfer rollers 71 and 76 on the one hand, and the screen roller 67, or the ink transfer rollers 72 and 77 on the other hand. Once the ink transfer rollers 71 and 76 are again fixed in place, the entire inking unit 66 has been set in its entirety.

If the ink transfer rollers 71, 72, 76, 77, or the ink application rollers 73, 78, which are individually arranged one behind the other in the roller trains 69 or 74, are set on one after the other, the outlay for technical apparatus for this application is considerably reduced, because the same setting devices can be used for setting each of the individual rollers 71, 72, 76, 77, 73, 78. By setting of the individual rollers 71, 72, 76, 77, 73, 78 by the use of pressure chambers being charged with air, it is sufficient, for example, to only provide two proportional valves, since these two valves can be used, one after the other, for setting the individual rollers 71, 72, 76, 77, 73, 78. Moreover, by setting the individual rollers 71, 72, 76, 77, 73, 78 one after the other, it is assured that the settings of the individual rollers 71, 72, 76, 77, 73, 78 do not affect each other. However, setting the individual rollers 71, 72, 76, 77, 73, 78 one after the other requires a relatively long setting time.

In accordance with a second alternative method, the ink transfer rollers 71, 72, 76, 77, or the ink application rollers 73, 78, are simultaneously set. This means that the pressure chambers at the individual ink transfer rollers 71, 72, 76, 77, or ink application rollers 73, 78, are simultaneously charged with suitable air pressures. However, care should be taken in this procedure that the contact pressure between the individual rollers 71, 72, 76, 77, 73, 78 also affects the rollers 71, 72, 76, 77, 73, 78 arranged upstream or downstream of them in the roller trains 69 or 74, so that the setting of the individual rollers 71, 72, 76, 77, 73, 78 is mutually affected.

When selecting the air pressures in the individual pressure chamber for setting the various rollers 71, 72, 76, 77, 73, 78, the force vectors acting on the individual rollers 71, 72, 76, 77, 73, 78 must be vectorially added.

Figure 8:
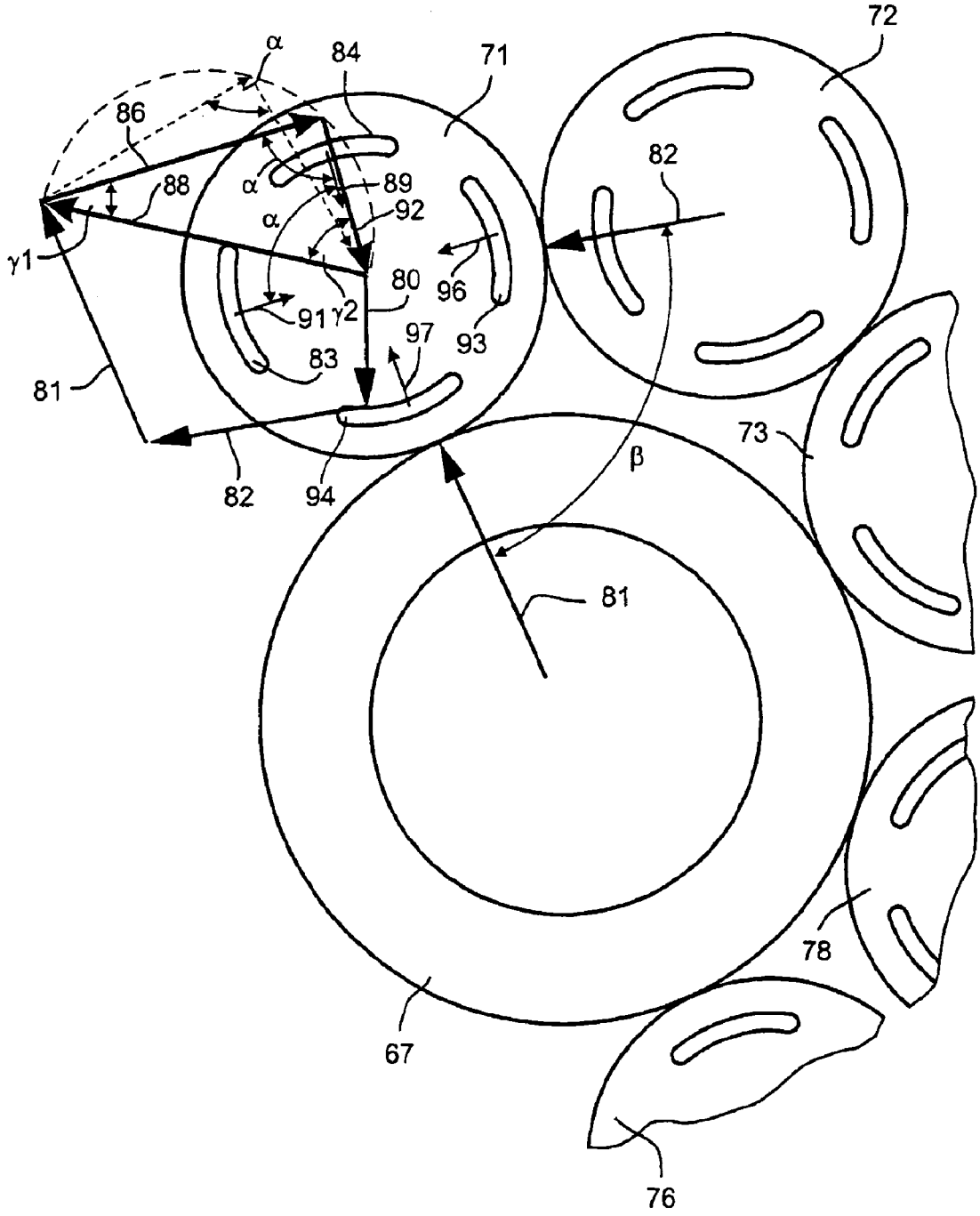

Such an addition of the force vectors is represented, by way of example, for the ink transfer roller 71 depicted in FIG. 8. In addition to the force vector 80, which is, for example, constituted by the force of the weight of roller 71, force vectors 81 and 82 also act on the ink transfer roller 71. These correspond, for example, to the contact pressures 81 and 82 acting in the roller strips and, at preset contact pressures, act between the ink transfer roller 71 and the screen roller 67 and the ink transfer roller 72. If the force of weight 80 and the contact pressures 81 and 82 are vectorially added, a force difference results, a force difference which must be compensated for by setting the air pressure in the air chambers 83 and 84 in such away that, as a result, no resultant exterior force acts on the ink transfer roller 71. The force vector 86, which is provided by the pressure chamber 83, and is, for example, the setting force 86, together with the force vector 87, which is provided by the pressure chamber 84, and is, for example, the setting force 87, are vectorially applied in FIG. 8. It can be seen that the force vectors 81, 82, 86, 87 result in a closed force flux and as a result no additional exterior forces act on the ink transfer roller 71. In the course of the simultaneous setting of the contact pressures of all of the rollers 71, 72, 76, 77, 73, 78, shown in FIG. 7, it is necessary to provide such a closed force flux for each one of the adjustable rollers 71, 72, 76, 77, 73, 78, in order to be able to take the effects of the various force values on each other into consideration.

A method for setting a contact pressure 81, 82 exerted by a first roller 71 on a second roller 72 and on at least a third roller 67 in a printing press, wherein the first roller 71 is held in a roller holder 27, which roller holder 27 is, in turn, seated in a frame holder 26 has thus been described. At least two actuators 83, 84, 93, 94 are arranged between the roller holder 27 and the frame holder 26, and in their actuated operational state, the actuators 83, 84, 93, 94 each exert a force 89, 91,96, 97, which is radially directed with respect to the roller holder 27. This method includes, as method steps, that a resultant force 88 is formed as the vector sum of all forces 80, 81, 82 acting on the first roller 71 after it has been set, that those actuators 83, 84 are actuated by a control signal, and whose radial forces 89, 91 act counter to the resultant force 88, and that the radial forces 89, 91 of the operated actuators 83, 84 are set to a value 86, 92 until their vector sum corresponds to the resultant force 88. This method assumes that, at the start of the process, at least a portion of the forces 81, 82 acting on the first roller 71 are not yet actually being exerted, but that they are desired values to be attained, since at least the contact pressures 81, 82 are yet to be set to a desired value, by using the proposed method. Therefore, the resultant force 88, formed as a vector sum, is a predetermined desired value, to which the radial forces 89, 91 are set by vectorial addition.

In the case of disengaging a first roller 71 from at least a second roller 67, 72 in a printing press, wherein the first roller 71 is held in a roller holder 27, which, in turn, is seated in a frame holder 26, and wherein at least two actuators 83, 84, 93, 94 are arranged between the roller holder 27 and the frame holder 26, and further wherein, in their actuated operational state, the actuators 83, 84, 93, 94 exert a force 89, 91,96, 97, which is radially directed to the roller holder 27, a method results in an analogous manner. This method is distinguished from the method discussed above in that a resultant 88 is formed as the vector sum of all of the forces 80, 81, 82 acting on the first roller 71 after it has been disengaged, that at least one actuator 83, 84 is actuated by a control signal, and whose radial force 89, 91 acts counter to the resultant 88, and that the radial force 89, 91 of the operated actuators 83, 84 is set to a value 86, 92 which corresponds to the vector sum of the resultant 88.

In both of the above described methods, the force 80 of the weight of the first roller 71 is preferably included in the vector sum for forming the resultant 88 because, as a rule, its value in the vector sum is not negligibly small. If now the force 80 of the weight of the first roller 71 alone constitutes the resultant 88, for example because no contact pressures at all act on the first roller 71, the radial force 91, 97 of the operated actuators 83, 84 is at least temporarily set to a value of 86, 98, so that their vector sum during the disengagement has a greater value than the resultant 88. This method step is used for disengaging the first roller 71, i.e. for the provision of a force which is sufficient to cause the first roller 71 to make a movement. After the first roller 71 has reached a defined position, only a value of a force counteracting the resultant 88 is required which is sufficient to maintain the first roller 71 in a state of rest. Therefore, in the preferred embodiment, the operated actuators 83, 84, 93, 94 displace the roller holder 27 in the frame holder 26, in the course of which operation, the actuators 83, 84, 93, 94 can displace the center of the roller holder 27 through a distance of up to 15 mm eccentrically away from the center of the frame holder 26, for example. In this case, the roller holder 27 can be eccentrically displaceable in the frame holder 26 in such a way that the first roller 71 and the second roller 72 come out of contact with each other, and wherein this displacement can be caused by the actuation of only a single actuator 83, 84, 93, 94 arranged between the roller holder 27 and the frame holder 26. At least one spring element can also be provided between the roller holder 27 and the frame holder 26, against which the actuators 83, 84, 93, 94 displace the roller holder 27 in the frame holder 26, and which at least one spring element resets the roller holder 27 into an initial position in the operational state in which it is not acted upon by the actuators 83, 84, 93, 94.

For executing the above described method, only those actuators 83, 84, 93, 94 are preferably operated, whose radial force shows a positive value 86, 92, 98 against the resultant 88. It is of advantage if the roller holder 27 is fixed in the frame holder 26, for example in the fashion described in connection with FIG. 1, after the vector sum of the radial forces 89, 91, 97 set to the value 86, 92, 98 corresponds to the resultant 88.

A contact pressure setting device 20 is usable for setting a contact pressure 81, 82, which is exerted by a first roller 71 on a second roller 72 and also on at least a third roller 67 of a printing press, and/or for the engagement or the disengagement of a first roller 71 with or from a second roller 72 and with or from at least a third roller 67, and therefore for executing the previously described method. The first roller 71 is held in a first roller holder 27 which, in turn is seated in a frame holder 26. At least two actuators 83, 84, 93, 94 are arranged between the roller holder 27 and the frame holder 26. In their actuated operating state, the actuators 83, 84, 93, 94 exert a force 89, 91, 96, 97 which is radially directed on the roller holder 27. This device can be distinguished, for example, in that at least one radial force 89, 91 of the actuators 83, 84, operated by a control signal, is aligned with a force 80, 81, 82 acting on the first roller 71. A further special arrangement for the above mentioned device 20 results, if two actuators 83, 84, operated by a control signal, are arranged in such a way, that the value 86, 92 of their radial force 89, 91 is set to the same value, and a vector sum of these values 86, 92 counteracts a resultant 88, wherein the resultant 88 is formed in the previously mentioned method as a vector sum of all forces 80, 81, 82 acting on the first roller 71.

As can be seen in FIG. 8, the radial forces 89, 91 of the actuators 83, 84 form an opening angle α with each other. The radial forces 89, 91 must provide the values of force 86, 92, which, by vectorial addition, are of equal size, in respect to the resultant 88. The opening angle α a between the radial forces 89, 91 exerted by the actuators 83, 84, after they have been actuated, i.e. after they have been charged with a pressure medium, can also be found between the force vectors 86, 92 which are oriented parallel with the radial forces 89, 91. Depending on the arrangement of the actuators 83, 84, different opening angles γ1, γ2 result in the diagram of the force vectors 86, 88, 92 between the resultant 88 and the force vectors 86, 92 which, however, should be at least 15° for creating advantageous force relationships. It is therefore advantageous to select the angular position of the radial forces 89, 91 exerted by the actuators 83, 84 in such a way that the radial force 89, 91 of two actuators 83, 84, actuated by a control signal, is set in such a way that each one of these radial forces 89, 91 has a value 86, 92 of at least 30%, preferably of 50%, and in particular of 70%, of an oppositely acting resultant 88, wherein the resultant 88 is again formed as a vector sum from all forces 80, 81, 82 acting on the first roller 71. Otherwise, one of the two actuators 83, 84 must supply an excessively large force proportion 86, 92, while the other one of the two actuators 83, 84 would be scarcely used. Since the forces to be supplied by the actuators 83, 84 are limited in their values in actual use, those arrangements are advantageous, wherein, under the given structural conditions, the involved actuators 83, 84 each put out as equal as possible a value, which value, as seen in FIG. 8, is, for example, indicated by the two force vectors in dashed lines, which, in this example, both have a proportion of 70% of the counteracting resultant 88. In FIG. 8, the opening angle α between the radial forces 89, 91 was selected, by way of example, to be 90°, so that the force vectors 86, 92, extending orthogonally in respect to each other, and the resultant 33 always form a right triangle with each other, and wherein the vertex of the opening angle α existing between the radial forces 89, 91 is displaced on a circular arc line drawn in dashed lines in FIG. 8, depending on the distribution of the radial forces 89, 91. Other advantageous settings of the opening angle α can lie between 45° and 135°, and in particular, at 90° and also at 120°. The opening angle α, which the radial forces 89, 91 of the operated actuators 83, 84 form with each other, is, in many roller arrangements, unequal to an opening angle β, which is formed by the contact force 82 exerted by the first roller 71 on the second roller 72, and with the contact force 81 exerted by the first roller 71 on the third roller 67. The opening angle β is for example 30° and 180°, but preferably lies between 60° and 120°, and, in particular, is at approximately 90°.

In a preferred embodiment of the contact pressure setting device 20, the actuators 83, 84, 93, 94 are formed in or on a wall of the frame holder 27, namely preferably as laterally limited pressure chambers which are attached in or on a wall of the frame holder 26 or the roller holder 27, as may be seen in FIG. 4. When charged with pressure, the pressure chambers perform a radial lift directed toward the roller holder 27, which can be up to 10 mm, for example.

It is advantageous if the frame holder 26 has connectors for service lines for the pressure medium supply for the hollow bodies, or pressure chambers, as seen in FIGS. 4 and 5. At least the frame holder 26 should advantageously be embodied to be rotationally symmetrical, because then no special alignment with a frame wall 79, shown in FIG. 7, need to be provided during the mounting of frame holder 26. The pressure chambers can have a diaphragm, wherein at least one strip formed on the frame holder 27 is embodied between the pressure chambers, as seen in FIG. 4 with which the diaphragm can be connected. In the structural configuration, either one ring-shaped diaphragm, which is closed in itself, covers all of the pressure chambers, or an associated diaphragm is provided for each pressure chamber. The latter embodiment is represented in FIG. 4. The diaphragm is preferably placed, glued or clamped into a groove cut into the frame holder 26. Three or four actuators 83, 84, 93, 94 or pressure chambers can be advantageously provided in the contact pressure setting device 20, which three or four actuators are arranged, preferably equidistantly spaced, along the circumference of the roller holder 27.

Figure 9:
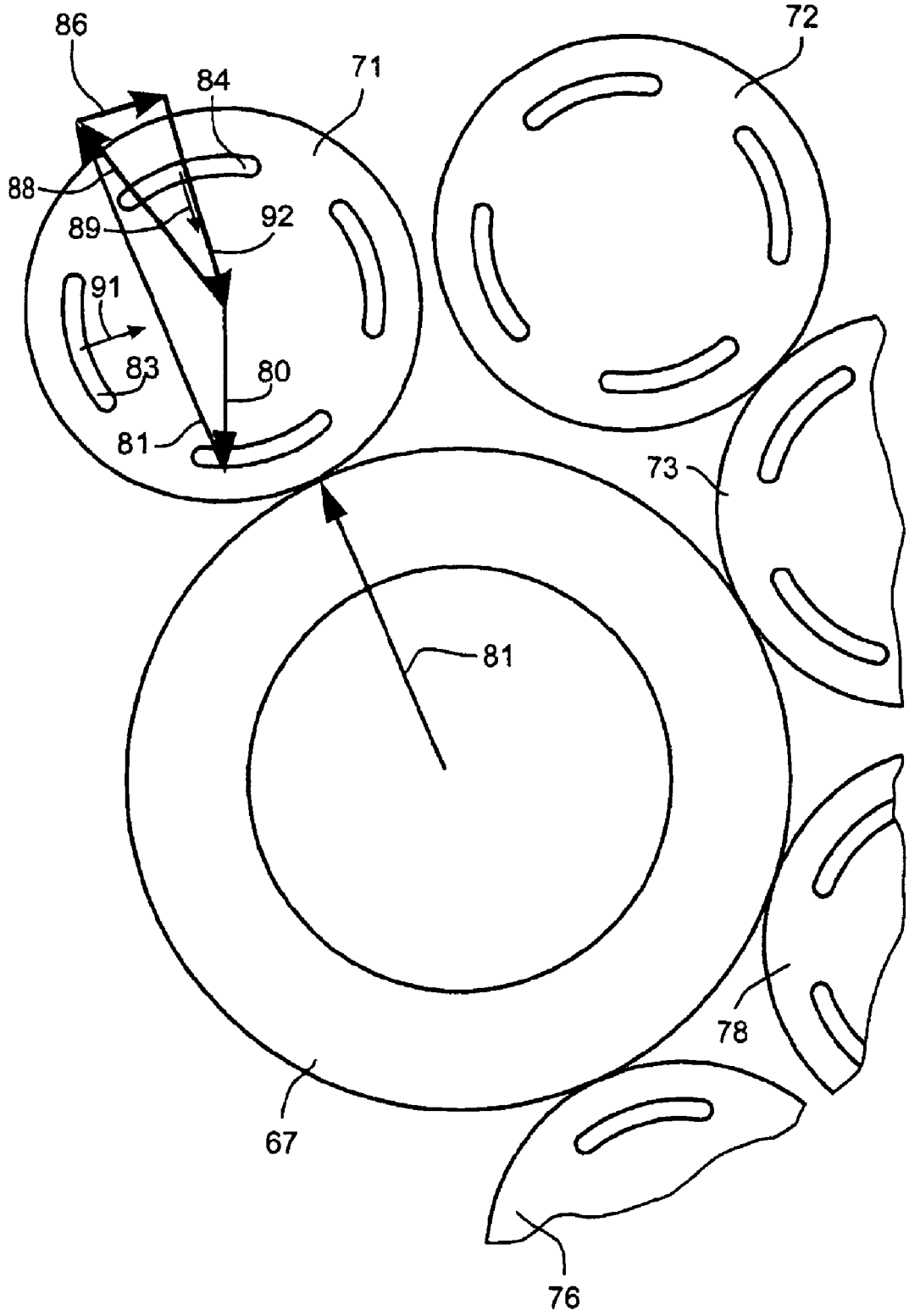
Figure 10:
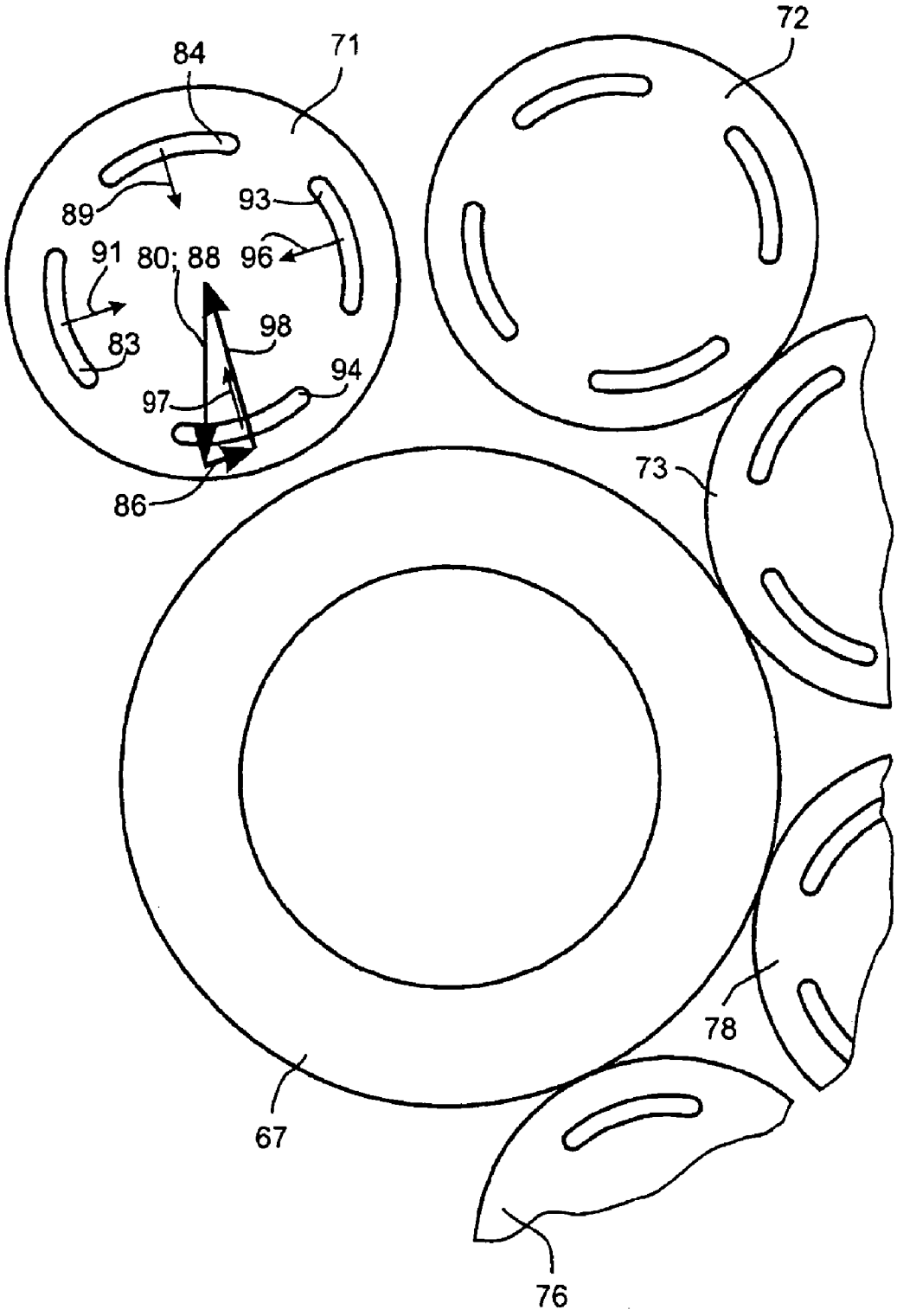

FIG. 9 shows an arrangement which is similar to the one shown in FIG. 8, but with the difference being that, in accordance with the portion of the inking unit represented in FIG. 9, two rollers 67, 71 have been placed against each other. An associated diagram of the force vectors 80, 81 86, 88, 92 has been drawn in, wherein the actuators 83, 84 provide the required forces 86, 92. In FIG. 10, the roller 71 of the same inking unit is completely disengaged from its adjoining rollers 67, 72. An associated diagram of the force vectors again illustrates the effective force relations wherein, for achieving this operational state of the roller arrangement, the actuators 83, 94 working with the roller 71 must be actuated.

Figure 11:
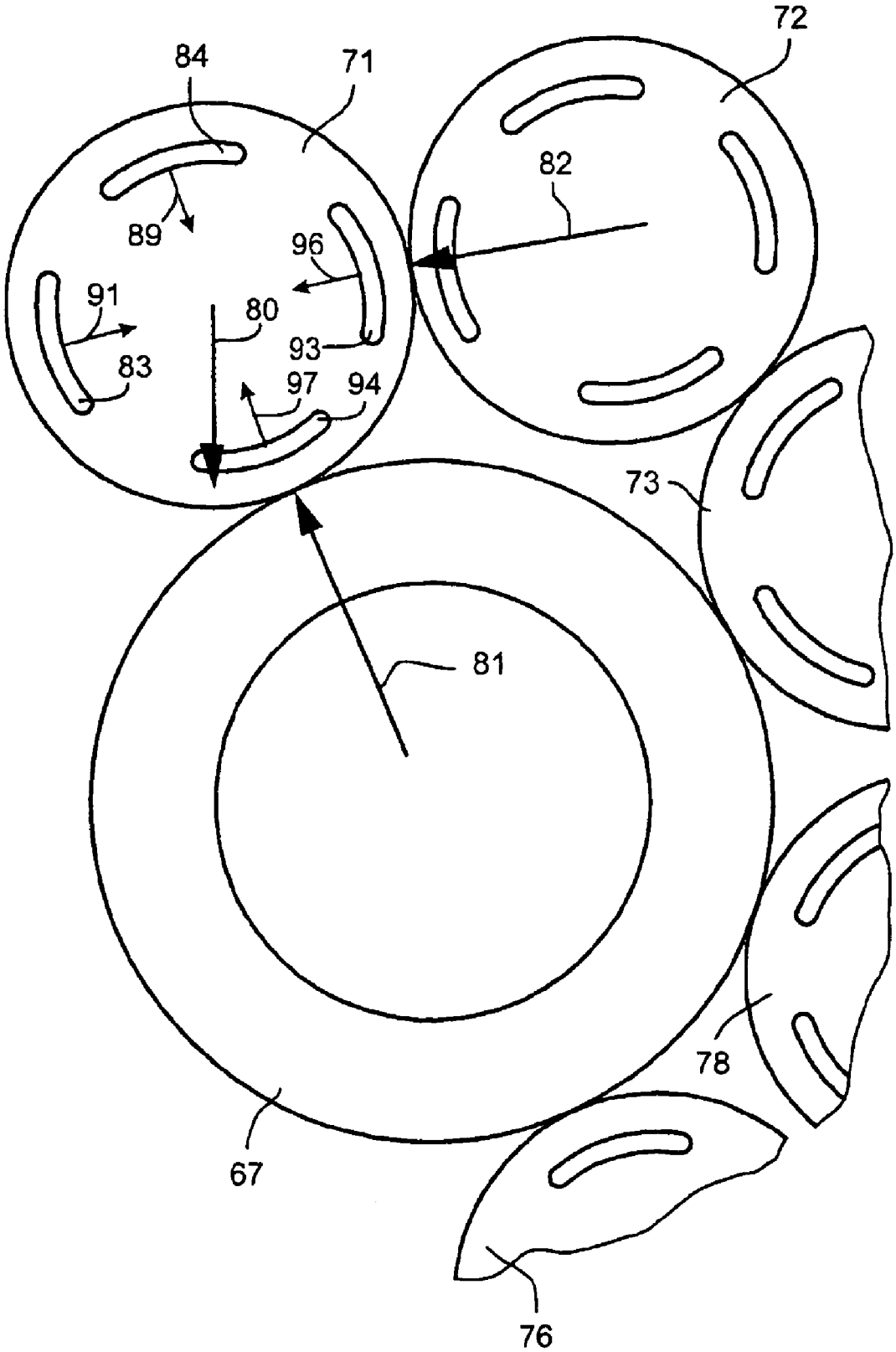

FIG. 11 shows a portion of an inking unit with a roller 71 placed against two additional rollers 67, 72, and with a representation of the radial forces 89, 91, 96, 97 of the actuators 83, 84, 93, 94, which are respectively arranged offset by 90° from each other. The contact forces 81, 82 must be provided and the force 80 of the weight acting on the roller 71 must be compensated for with this arrangement. By such an arrangement of actuators 83, 84, 93, 94, it is possible to perform a displacement of the roller 71 in any desired direction in the actuating plane, which here is the same as the drawing plane. Some devices 20 for setting a contact force 82 exerted by a first roller 71 on at least a second roller 72 of a printing press, and/or for placing a first roller 71 against or for moving a first roller 71 away from at least a second roller 72, might not need all these represented actuators 83, 84, 93, 94. At least two actuators 83, 84, in their actuated operating state, i.e. in their state charged with a pressure medium, exert a force 89, 91 directed radially to the first roller 71. A preferably prestressed spring element, for example, is provided in the opposite direction of the radial force 89, 91.

Figure 12:
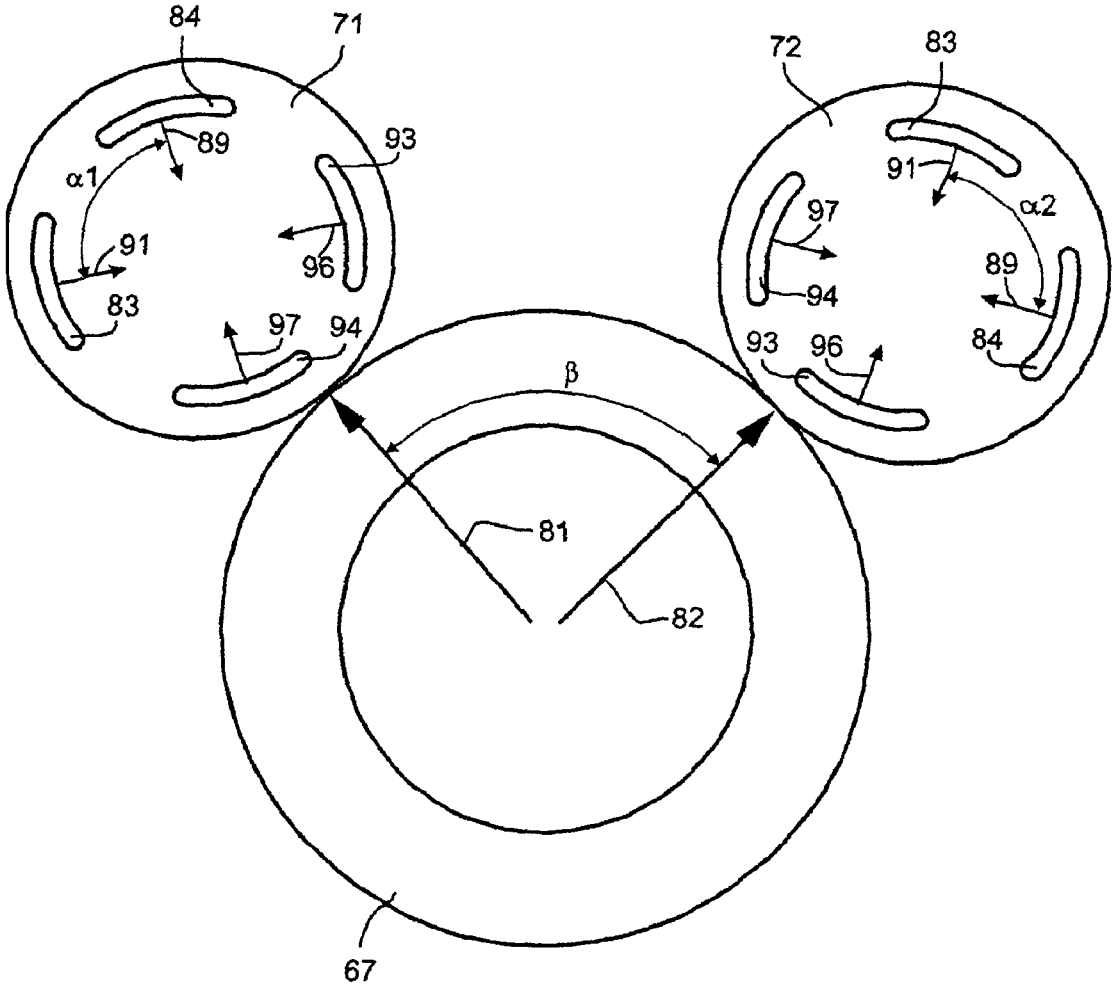

A third preferred embodiment of a roller arrangement is represented in FIG. 12. It relates to a device 20 for setting a contact pressure 81, 82 exerted by a first roller 71 and by a second roller 72 on at least a third roller 67 of a printing press, and for the engagement or for the disengagement of a first roller 71 and at least a second roller 72, with or from a third roller 67. Actuators 83, 84, 93, 94 are provided for the first roller 71 and the second roller 72 which, in their actuated operating state exert a radial force 89, 91, 96, 97, which radial force is respectively directed onto the rollers 71, 72 which are in connection with them. This contact pressure setting device 20 is distinguished in that an opening angle α1, α2 between the radial forces 89, 91 directed by two actuators 83, 84 on the same roller 71, 72 is equal at the first roller 71 and the second roller 72. In this case, the radial forces 89, 91, 96, 97 of the operated actuators 83, 84, 93, 94, each form an opening angle α1, α2 with each other in the first roller 71 and the second roller 72, which is not equal to an opening angle β, which is formed by the contact force 82 exerted by the first roller 71 on the third roller 67 and by the contact force 81 exerted by the second roller 72 on the third roller 67. As in the previously described contact pressure setting devices 20, the actuators 83, 84, 93, 94 exert their radial force upon their actuation by a control signal. The actuators 83, 84, 93, 94 can, for example, be actuated from a control console, which may be, for example, assigned to the printing press. The opening angles α, α1, α2, which the radial forces 89, 91 of the operated actuators 83, 84 form with each other can be, for example, between 45° and 135°, and preferably are between 90° and 120°. The opening angle β, which the contact force 82, exerted by the first roller 71 on the third roller 67, forms with the contact force 81, exerted by the second roller 72 on the third roller 67, can be, for example, between 30° and 180°, preferably is between 60° to 120°, and in particular is 90°.

With this contact pressure setting device 20, too, with two rollers 71, 72, which can be placed independently of each other against the third roller 67, the first roller 71 and/or the second roller 72 can be held in a roller holder 27, which, in turn, is seated in a frame holder 26, and wherein the actuators 83, 84, 93, 94 are preferably arranged between the frame holder 26 and the roller holder 27. The frame holder 26 is advantageously embodied as a housing in which the actuators 83, 84, 93, 94 are arranged, as may be seen in FIG. 4 or 5, and wherein the housing is embodied at least as a half shell. It is again recommended to embody the actuators 83, 84, 93, 94 as hollow bodies which can be charged with a pressure fluid and which are embodied, for example, to be pneumatically operable and preferably are formed without piston rods. It is of advantage to make the hollow body, or bodies at least partially from an elastomeric material. In this roller arrangement, the first roller 71 or the second roller 72 can also be a roller of an inking unit or of a dampening unit.

Figure 13:
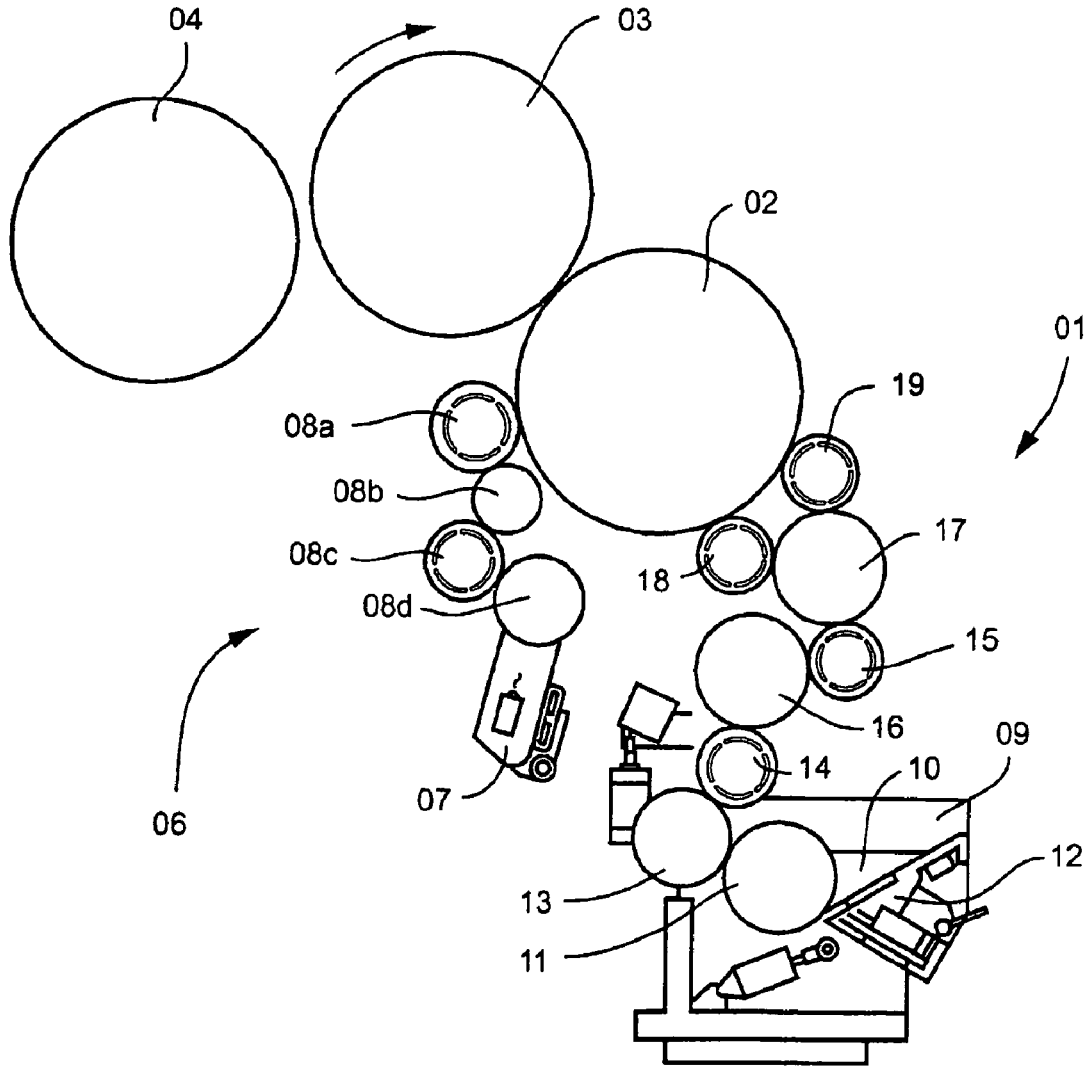

The inking unit 01 represented in FIG. 13 is used for applying printing ink to a cylinder 02, for example a forme cylinder 02, which in turn transfers the printing ink to a rubber blanket cylinder 03. A web of material, which is not specifically represented in FIG. 13, for example a web of material to be imprinted, specifically for example a paper web, is passed between the rubber blanket cylinder 03 and a counter-pressure cylinder 04 and is imprinted with the desired printed image by contact with the rubber blanket cylinder 03. For providing the moisture required for the transfer of the printed image, a dampening unit 06, with a spray device 07, and with various rollers 08*a*, 08*b*, 08*c*, 08*d*, for example dampening rollers 08*a*, 08*b*, 08*c*, 08*d*, is provided.

A defined amount of a pasty printing ink 10 is stored in a reservoir 09, embodied as an ink duct. The printing ink 10 can be further conveyed, in a suitable manner, by the use of an ink ductor 11, working together with an ink blade 12. An ink film of a defined thickness is transferred by the ink ductor 11 to a downstream-connected roller 13, for example a film roller 13. During a rolling off on each other of surfaces of the rollers 14, 15, which surfaces respectively rest against each other, and which rollers 14, 15 may be, for example, ink transfer rollers 14, 15, or of the respectively downstream-connected rollers 16, 17, for example ink distribution roller 16, 17, the printing ink 10 is then transferred to two rollers 18, 19, for example two ink application rollers 18, 19. The ink application rollers 18, 19, in turn, roll off on the forme cylinder 02, and in the process place the conveyed printing ink 10 on the forme cylinder 02.

The forme cylinder 02, the ink distribution rollers 16, 17, the film roller 13 and the ink ductor 11 are all fixedly seated in a machine frame, which is not specifically represented in FIG. 13. Within the scope of this invention, this means that the setting pressure between the individual rollers 16, 17, 13, or the cylinder 02, cannot be changed by adjusting these rollers 16, 17, 13, or cylinders 02. The ink distribution rollers 16, 17 can, of course, be moved in the axial direction, in relation to the machine frame, in order to distribute the ink on the ink transfer rollers 14 or 15 and on the ink application rollers 18 or 19, which rest against them. The distance of the spacing of the shafts of the "fixed" rollers is therefore not changeable.

Each of the ink transfer rollers 14 or 15, and the ink application rollers 18 or 19 are seated, by the use of two contact pressure sensing devices 20, at the oppositely located sides of the machine frame, so that a displacement of the ink transfer rollers 14 or 15, and of the ink application rollers 18 or 19 between the rollers 16, 17, 13 or the cylinder 02 in the roller train of the inking unit 01 is possible by actuating these contact pressure setting devices 20. The contact pressure exerted in the roller strips between the ink transfer rollers 14 or 15, and the ink application rollers 18 or 19, on the one hand, and between the forme cylinder 02, the ink distribution rollers 16, 17 and between the film roller 13 and the ink ductor 11 on the other hand, can be set sequentially. The setting of the inking unit can be accomplished particularly quickly by simultaneously setting the contact pressure in all of the roller strips. For this purpose, the contact pressure setting devices 20, in which the ink transfer rollers 14 or 15 and the ink application rollers 18 or 19 are seated, are actuated substantially at the same time. Therefore, an influence of the contact pressure in the individual roller strips is impossible even when all of the devices are being actuated simultaneously, because a roller 16 or 17 seated fixed in the frame, namely the ink distribution roller 16 or 17, is arranged between each of the adjustably seated ink transfer rollers 14 or 15 and ink application rollers 18 or 19.

The dampening rollers 08*a* or 08*c*, which are adjustably seated on the dampening unit 06 by the contact pressure setting devices 20, are arranged between the dampening rollers 08*b* or 08, which are seated fixed in the frame, and the forme cylinder 02, which are also seated fixed in the frame.

While preferred embodiments of a method and devices for regulating at least one cylinder in a printing machine, in accordance with the present invention, have been set forth fully and completely hereinabove, it will be apparent to one of skill in the art that various changes in, for example the overall sizes of the cylinders, the source of supply of the pressure fluid and the like can be made without departing from the true spirit and scope of the present invention which is accordingly to be limited only by the appended claims.

What is claimed is:

1. A method for setting a contact pressure exerted by a first roller on at least a second roller and third roller in a printing press including:

supporting said first roller in a first roller holder;

supporting said first roller holder in a frame holder;

providing at least two actuators between said roller holder and said frame holder;

operating each said actuator for exerting a force directed radially onto said roller holder;

forming a resultant force as a vector sum of all forces acting after setting said contact pressure exerted by said first roller against said second and third roller;

actuating ones of said actuators having radial forces counteracting said resultant force;

setting a value of said radial force of said operated actuators so that their vector sum corresponds to said resultant force;

providing a control signal for said at least two actuators; and defining an opening angle between said radially directed force exerted by said at least two actuators and said resultant force as at least 15°.

2. The method of claim 1 further including a force of a weight of said first roller in said vector sum.

3. The method of claim 1 further including operating one of said at least two actuators whose resultant force has a positive value with respect to said resultant force.

4. The method of claim 1 further including fixing said roller holder in place in said frame holder after said radial forces vector sum equals said resultant force.

5. The method of claim 1 further including using said at least two actuators for displacing said roller holding in said frame holder.

6. The method of claim 5 further including displacing said roller holder by up to 15 mm eccentrically in said frame holder.

7. A method for disengaging a first roller from at least a second roller in a printing press including:

supporting said first roller is a first roller holder;

supporting said first roller holder is a frame holder;

providing at least two actuators between said roller holder and said frame holder;

operating said actuators for each exerting a force directed radially onto said roller holder;

forming a resultant force as a vector sum of all the forces acting after setting a contact pressure exerted by said first roller against said second roller;

actuating at least one of said actuators whose radial force counteracts said resultant force;

setting said radial force of said at least one actuator to a value corresponding to said vector sum of said resultant force;

actuating said actuator by using a control signal; and defining an opening angle between said radially directed force exerted by said at least two actuators and said vector force as at least 15°.

8. The method of claim 7 further including a force of a weight of said first roller in said vector sum.

9. The method of claim 8 wherein said force of said weight alone constitutes said resultant force, said radial force of said at least two actuators being set at a disengaged value greater than said resultant force.

10. The method of claim 7 further including operating one of said at least two actuators whose resultant force has a positive value with respect to said resultant force.

11. The method of claim 7 further including fixing said roller holder in place in said frame holder after said radial forces vector sum equals said resultant force.

12. The method of claim 7 further including using said at least two actuators for displacing said roller holding in said frame holder.

13. The method of claim 12 further including displacing said roller holder by up to 15 mm eccentrically in said frame holder.

14. A device for setting a contact pressure exerted by a first roller against a second roller and at least a third roller in a printing press during engagement and disengagement of said first roller with respect to said second and at least third roller comprising:

a roller holder adapted to support said first roller;

a frame holder in which said roller holder is seated;

at least two actuators arranged between said roller holder and said forme holder;

means for actuating said at least two actuators for exerting a force directed radially onto said roller holder;

a control signal adapted to actuate said at least two actuators;

a resultant force formed as a vector sum of all forces acting on said first roller, each of said radially directed forces having a value of at least 30% of said resultant force;

a first opening angle determined by said radially directed forces of said two operating actuators; and a second opening angle defined by a contact force exerted by said first roller on said second roller and a second contact force exerted by said first roller on said third roller, said first opening angle and said second opening angle being not equal.

15. The device of claim 14 wherein said first opening angle lies between 45° and 135°.

16. The device of claim 14 wherein said second opening angle lies between 30° and 180°.

17. The device of claim 14 further wherein at least one of said actuators is adapted to bring said first roller and said second roller out of contact.

18. The device of claim 14 further including a fixing device adapted to fix said roller holder in place in said frame holder.

19. The device of claim 14 further including a spring element displaced between said roller holder and said frame holder, said spring element exerting a spring force acting against said actuators.

20. The device of claim 14 wherein said actuators are hollow bodies adapted to be charged with compressed air.

21. The device of claim 20 wherein said hollow body is an elastomeric material.

22. The device of claim 20 further including service lines in said frame holder and adapted to supply compressed air to said hollow bodies.

23. The device of claim 20 wherein said hollow bodies are pressure chambers including a diaphragm.

24. The device of claim 14 further including a frame holder wall and wherein said at least two actuators are in engagement with said frame holder wall.

25. The device of claim 14 wherein said at least two actuators are pressure chambers and wherein said frame holder and said roller holder each include a wall, said pressure chambers being positioned between said frame holder wall and said roller holder wall, said at least two actuators effecting a radial displacement of said roller holder when actuated.

26. The device of claim 25 wherein said radial displacement is up to 10 mm.

27. The device of claim 14 wherein said frame holder is rotationally symmetrical.

28. The device of claim 14 wherein each of said actuators is a pressure chamber and further including a ring-shaped diaphragm covering all of said pressure chambers.

29. The device of claim 14 wherein each of said actuators is a pressure chamber and further including a diaphragm associated with each said pressure chamber.

30. The device of claim 14 wherein each of said actuators is a pressure chamber and further including a groove in a wall of said frame holder, each said pressure chamber being secured in said groove.

31. The device of claim 14 further including at least three of said actuators.

32. The device of claim 14 wherein said at least two actuators are spaced equidistantly apart along a circumference of said roller holder.

33. The device of claim 14 wherein said frame holder is a housing in which said at least two actuators are received.

34. The device of claim 14 wherein one of said rollers cooperates with a forme cylinder.

35. The device of claim 14 wherein all of said rollers can be set and engaged and disengaged.

36. The device of claim 14 wherein all of said rollers can be set and engaged and disengaged.

37. A device for setting a contact pressure exerted by a first roller against a second roller and at least a third roller in a printing press during engagement and disengagement of said first roller with respect to said second roller and said at least third roller comprising:

a roller holder adapted to support said first roller;

a frame holder in which said roller holder is seated;

at least two actuators arranged between said roller holder and said frame holder;

means for actuating said at least two actuators for exerting a force directed radially onto said roller holder;

a control signal adapted to actuate said at least two actuators;

a resultant force formed as a vector sum of all forces acting on said first roller;

an opening angle of at least 15° defined by said radially directed force and said resultant force counteracting said radially directed force; and means for eccentrically displaced said roller holder in said frame holder to move said first roller and said second roller out of contact.

38. The device of claim 37 further including a fixing device adapted to fix said roller holder in place in said frame holder.

39. The device of claim 37 further including a spring element displaced between said roller holder and said frame holder, said spring element exerting a spring force acting against said actuators.

40. The device of claim 37 wherein said actuators are hollow bodies adapted to be charged with compressed air.

41. The device of claim 40 wherein said hollow body is an elastomeric material.

42. The device of claim 40 further including service lines in said frame holder and adapted to supply compressed air to said hollow bodies.

43. The device of claim 40 wherein said hollow bodies are pressure chambers including a diaphragm.

44. The device of claim 37 further including a frame holder wall and wherein said at least two actuators are in engagement with said frame holder wall.

45. The device of claim 37 wherein said at least two actuators are pressure chambers and wherein said frame holder and said roller holder each include a wall, said pressure chambers being positioned between said frame holder wall and said roller holder wall, said at least two actuators effecting a radial displacement of said roller holder when actuated.

46. The device of claim 45 wherein said radial displacement is up to 10 mm.

47. The device of claim 37 wherein said frame holder is rotationally symmetrical.

48. The device of claim 37 wherein each of said actuators is a pressure chamber and further including a ring-shaped diaphragm covering all of said pressure chambers.

49. The device of claim 37 wherein each of said actuators is a pressure chamber and further including a diaphragm associated with each said pressure chamber.

50. The device of claim 37 wherein each of said actuators is a pressure chamber and further including a groove in a wall of said frame holder, each said pressure chamber being secured in said groove.

51. The device of claim 37 further including at least three of said actuators.

52. The device of claim 37 wherein said at least two actuators are spaced equidistantly apart along a circumference of said roller holder.

53. The device of claim 37 wherein said frame holder is a housing in which said at least two actuators are received.

54. The device of claim 37 wherein one of said rollers cooperates with a forme cylinder.

* * * * *